United States Patent [19]

Kin

[11] Patent Number: 4,881,559

[45] **Date of Patent: * Nov. 21, 1989**

[54] HAIR CURLING SYSTEM

[75] Inventor: Lai Kin, Kowloon, Hong Kong

[73] Assignee: Windmere Corporation, Miami Lakes, Fla.

[ * ] Notice: The portion of the term of this patent subsequent to Nov. 25, 2003 has been disclaimed.

[21] Appl. No.: 934,081

[22] Filed: Nov. 24, 1986

Related U.S. Application Data

[63] Continuation of Ser. No. 503,181, Jun. 10, 1983, Pat. No. 4,564,033.

[51] Int. Cl.[4] ..... A45D 2/02

[52] U.S. Cl. ..... 132/226; 219/222

[58] Field of Search ..... 132/40, 39, 33 R, 226; 219/222

[56] References Cited

U.S. PATENT DOCUMENTS

| | | | |
|---|---|---|---|
| 3,415,254 | 12/1968 | Brock et al. | 219/222 |
| 3,472,245 | 10/1969 | Abe | 219/222 |
| 3,705,974 | 12/1972 | Nilsson | 219/222 |
| 3,858,029 | 12/1974 | Walter | 219/222 |
| 4,564,033 | 1/1986 | Kin | 132/226 |
| 4,624,271 | 11/1986 | Kin | 132/226 |

FOREIGN PATENT DOCUMENTS

| | | |
|---|---|---|
| 7009363 | 3/1970 | Fed. Rep. of Germany . |
| 801069162 | 4/1982 | United Kingdom . |

*Primary Examiner*—Gene Mancene
*Assistant Examiner*—J. Hakomaki
*Attorney, Agent, or Firm*—Dickstein, Shapiro & Morin

[57] ABSTRACT

A hair curling roller system having a plurality of post members having substantially the same outer diameter for heating the rollers and a plurality of rollers having inner cavities for mounting the rollers on the posts with such inner cavities having substantially the same inner diameters. There are at least two groups of the rollers, with the outer diameter of the rollers of one group being larger than the outer diameter of the rollers of the other group. Each of the curling rollers includes an interior core member having an opening in one lateral end of the core member and longitudinally extending within the core member; this core member is formed of a material highly conductive of heat. An elongated metal sleeve is positioned with the opening of the core member of each roller and is attached to the inside of such core member. In each of the larger rollers the interior core has a central hub and a plurality of heat radiating fins extending out from the hub for facilitating the transfer of heat to the outer surface of the roller. A hollow sleeve member with a flocked outer surface is arranged over the core member. First and second end rings are attached to the core member at the ends of the roller; each of these end rings has a flange extending over but spaced from the adjacent end portion of the flocked outer surface of the sleeve member.

30 Claims, 3 Drawing Sheets

HAIR CURLING SYSTEM

RELATED APPLICATIONS

The present application is a continuation of U.S. patent application Ser. No. 611,338, filed June 10, 1983, and entitled Hair Curling System, which is a continuation of U.S. patent application Ser. No. 611,338, filed May 17, 1984, now U.S. Pat. No. 4,624,271, which is a continuation-in-part of U.S. patent application Ser. No. 503,181, filed June 10, 1983, now U.S. Pat. No. 4,579,132 and entitled "Hair Curling System", now U.S. Pat. No. 4,564,033; the subject matter of said patent applications is hereby incorporated by reference. su

BACKGROUND OF THE INVENTION

The invention relates to a flocked hair curling roller system in which the rollers are heated by the insertion of a cylindrical heating post member in an interior cylindrical bore contained within the roller.

U.S. Pat. Nos. 3,519,792; 3,600,552; Re. No. 26,766 and Des. No. 256,509 disclose hair curling roller systems having a plurality of hair curling rollers mounted on post members which generate heat within the rollers. Typically in such systems the post members have been of the same size when the rollers are of the same size and where the rollers have varied in size the post members have varied in size for accommodating the different size rollers. U.S. Pat. Nos. 3,610,878 and 4,298,787 disclose hair curling roller systems having heating posts of different sizes for different size rollers.

For proper styling of the hair, it is desirable to use rollers of several different sizes. At the same time, it is convenient for the use of the hair curling roller system if all of the heating posts are of the same size so that the rollers can be placed onto any of the posts. If all of the posts are made with the same diameter then the posts must be small in order to accommodate the smaller rollers. In the larger rollers, however, if the diameter of the inner cavity into which the heating post is inserted is small so that the roller can be mounted on a small diameter post, the heat from the post does not sufficiently radiate out to the outer surface of the larger rollers. Consequently, when different size rollers are included in the system, larger heating posts have been included for heating the larger rollers.

U.S. Pat. Nos. 3,888,266 to Weldon and 4,202,360 to Walter both disclose flocked hair curling rollers. The hair curler disclosed in U.S. Pat. No. 3,888,266 has a flocked outer surface having a large number of upstanding short non-hydroscopic filaments or fibers capable of retaining moisture by capillary action. The hair curling roller disclosed in U.S. Pat. No. 4,202,360 has a cylindrical member having a flocked outer surface and a hollow cylindrical core which is adapted to receive a heating element. A pair of end caps are joined directly to the outside surface of the flocked roller at the ends of the cylinder An inner cylindrical surface of each of the end caps directly engages the outer surface of the flocked roller and in order to secure such engagement, protrusions on such inner surface extend into recesses on the roller. The protrusions alternatively may be carried by either the end cap or the end of the flocked roller with the recesses being on the other member.

The flocked hair curling roller disclosed in U.S. Pat. No. 4,202,360 does not contain a space between the outside surface of the flocked roller and the inside surface of the end caps at the point of engagement of the end caps with the flocked roller. Because of the periodic heating and cooling of the roller during its use and storage, the end caps are subjected to periodic expansion and contraction which may cause structural fatigue of the end caps thereby potentially damaging them.

Moreover, the direct engagement of the inner surface of the end caps disclosed in U.S. Pat. No. 4,202,360 with the outer flocked surface of the roller can cause the flocking to be rubbed off the edge of the roller in the area of overlap between the end caps and the roller.

U.S. patent application Ser. No. 463,662 to Arnold Thaler entitled "Flocked Hair Curling Roller" filed Feb. 4, 1983, which is assigned to the same assignee as the present application, discloses a flocked hair curling roller in which the end rings have flanges that extend over but are spaced from the layer of flocking material.

U.S. Pat. No. 3,209,766 discloses a hair curling roller with two snap on end caps. U.S. Pat. Nos. 698,578 and 4,403,621 disclose hair curlers having a plurality of longitudinally extending rods.

SUMMARY OF THE INVENTION

An object of the present invention is to provide an improved hair curling roller system.

Another object of the present invention is to provide an improved hair curling roller system in which all of the heating posts have substantially the same diameter and there are at least two different size rollers.

A further object of the present invention is to provide an improved flocked hair curling roller which creates a high heat transfer between a heating element disposed within a cylindrical bore within the roller and the exterior flocking carried on the outside surface of the roller.

Still another object of the present invention is to provide an improved flocked hair curling roller having an inner metal sleeve within its cylindrical bore for insertion on a heating element for improving the heat transfer characteristics of the roller for transferring heat between the heating element and the exterior flocking on the outside surface of the roller.

A further object of the present invention is to provide an improved hair curling roller system having at least two different size rollers with the large rollers having core sections constructed for facilitating the transfer of heat to the outer surface so that the outer surface of the larger rollers are heated to substantially the same level as the smaller roller.

A still further object of the present invention is to provide a flocked hair curling roller which is not subject to structural fatigue caused by expansion and contraction between the end caps and the outside surface of the hair curling roller to which the end caps are joined.

It is a still further object of the present invention to provide a flocked hair curling roller in which the flocking carried on the outside surface of the hair curling roller in proximity to the ends thereof is not rubbed off by the end caps attached to the end of the hair curling roller.

The hair curling roller system in accordance with the present invention includes a plurality of rollers and a plurality of post members for heating the rollers, which are mounted on the post members for heating. An elongated metal sleeve, or tube, is arranged within an elongated central inner cavity, or bore, in each of the rollers. The inner metal sleeve improves the transfer of heat from the heating element to the core of the roller and simultaneously protects the inner surface of the central inner cavity. The inner metal sleeve prevents the inner surface of the core member from sticking to the heating element when the roller is heated. While all of the post members having substantially the same diameter and the inner cavities of the rollers into which the post members are inserted have substantially the same diameter, the outer diameters of the rollers are of two different sizes. In addition to the use of the inner metal sleeve, the interior core of the rollers with the larger outer diameter is specially constructed for facilitating the transfer of heat from the inner cavity to the outer surface of the roller so that when the rollers are heated the level, i.e. temperature or concentration, of heat on the outer surface of all of the rollers is approximately the same. In the larger rollers, the inner core includes a cylindrical hub surrounding the inner cavity of the roller and a plurality of heat radiating ribs arranged around the hub and extending in a radial direction out from the hub with air spaces remaining between adjacent ribs; an outer sleeve then surrounds these ribs.

The hair curling rollers used in the roller system in accordance with the present invention preferably includes: a central core member having an opening in one lateral end of the core member and longitudinally extending within the core member to form an inner cavity and the core member being formed of a material highly conductive of heat; a metal sleeve member arranged inside of said inner cavity and attached to the core member such as during the molding process or by a press fitting of protrusions from the metal sleeve into the core member; a hollow sleeve member arranged on the core member, the sleeve member having a flocked outer surface; a first end ring attached to the core member at one lateral end thereof, the first end ring having a flange extending over but spaced from the adjacent end portion of the flocked outer surface of the sleeve member; and a second end ring having an attachment member, the second end ring being connected to the core member at the other lateral end thereof by the attachment member, the second end ring having a flange extending over but spaced from the adjacent end portion of the flocked outer surface. In accordance with the present invention, each of the larger rollers has a central core member with a plurality of heat radiating ribs extending out from this central core member and the flocked sleeve member surrounds the ribs.

The opening in the core member forming the inner cavity extends through the core member from one lateral end surface to the other lateral end surface. The attachment member is a prong mounted on an inner surface of the second end ring facing the core member, and the prong is inserted into the opening in the core member for securing the second end ring to the core member. The portion of the opening at the end of the core member adjacent the second end ring is of a smaller diameter than the remainder of the opening extending through the core member. The prong has two parts formed of a resilient material within a space between the parts so that the parts can be squeezed together upon insertion of the prong into the opening in the core member and snapped back to their original position once the prong is inserted so as to secure the second end ring to the core member.

The first and second end rings are preferably formed of a material having low heat conducting properties. The first end ring has an opening which is aligned with the opening in the core member and is approximately of the same diameter as the opening in the core member. The opening in the core member is of a sufficient diameter and of sufficient length measured from the first end ring to permit the insertion of the heating post member within the inner cavity within the core member for transmitting heat to the roller. The inner metal sleeve inside of the core member is formed of aluminum that is 0.5 mm thick. The flocking material is preferably formed of nylon which has a diameter preferably of 3 denier and a length of 0.5 mm.

A hair curling roller in accordance with the invention includes an interior core member having an inner hub and a plurality of ribs radially extending from such hub and a longitudinally extending cylindrical member surrounding such ribs; a first end ring mounted at one end of the cylindrical member and having a flange extending over but spaced from the adjacent portion of the outer surface of the cylindrical member; and a second end ring mounted at the opposite end of the cylindrical member, the second end ring having a flange extending over but spaced from the adjacent portion of the outer surface of the cylindrical member. The cylindrical member is formed of a heat conductive material. The first and second end rings are formed of a material having low heat conductive properties.

In order to further improve the transfer of heat between the central core member and the outer sleeve, a thin layer, or several thin layers, of a metal material, such as aluminum, can be wrapped around the ribs so as to lie between the ribs and the outer sleeve.

DESCRIPTION OF THE PREFERRED EMBODIMENT

Figure 1:
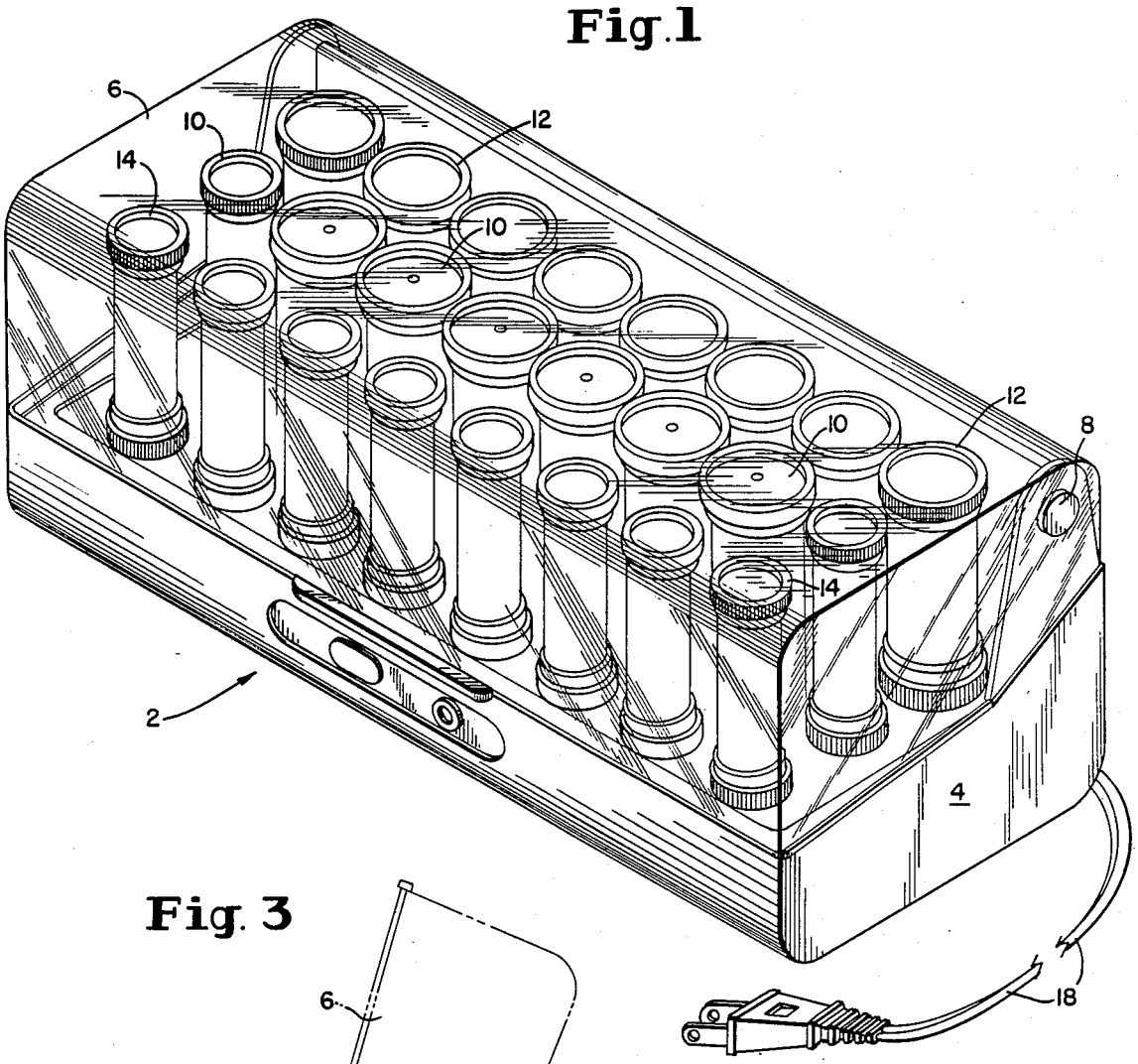
FIG. 1 is a perspective view of a hair curling roller set in accordance with the present invention.
Figure 2:
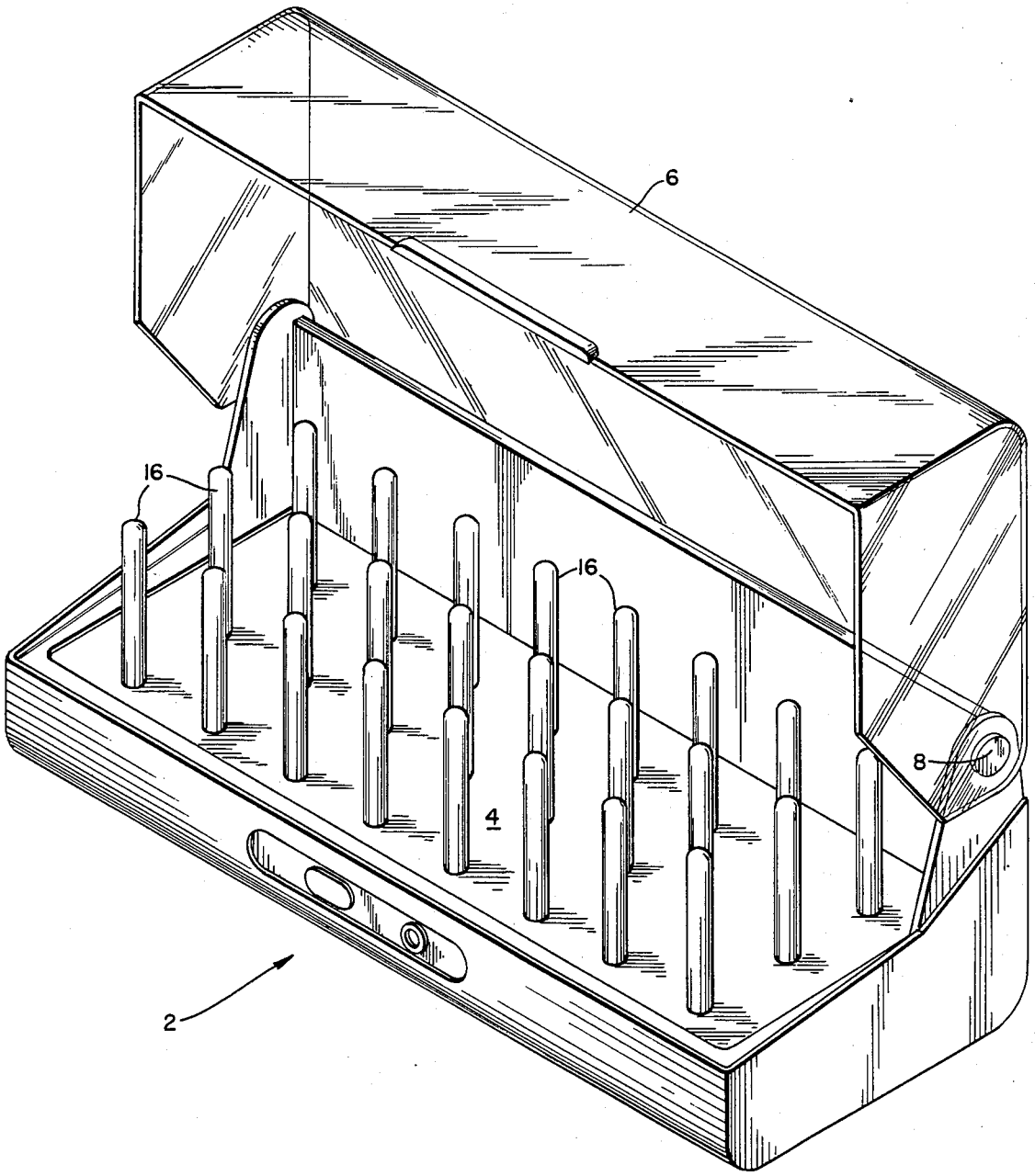
FIG. 2 is a view similar to FIG. 1 with the rollers removed so as to show the heating post members.
Figure 5:
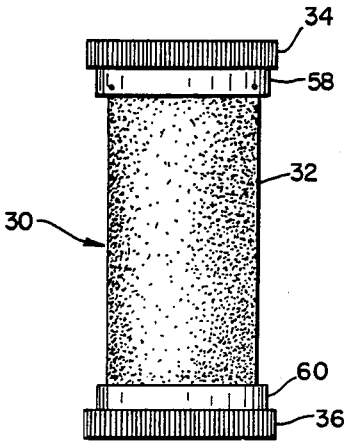
FIG. 5 is an elevational view of a flocked curling roller that can be used in accordance with the invention.

A hair curling roller set 2, such as shown in FIG. 1, has a housing 4 which is covered by a pivoted lid 6. Lid 6 is pivoted about bearings 8 located at the upper end of the rear of the housing. Inside of the housing there are a plurality of different sized hair rollers which are arranged on posts 16. Posts 16 are shown in FIG. 2 in which the hair rollers have been removed from the posts mounted on housing 4.

The hair curling rollers in curling set 2 are of three different sizes with the largest two types of rollers being shown by rollers 10 and 12, with roller 10 being larger than roller 12, and the smallest roller being shown by roller 14. Each of the hair rollers, 10, 12 and 14 in accordance with the preferred embodiment of the present invention are flocked hair curling rollers. Most hair curling roller sets include hair rollers of at least two different sizes and normally three different sizes such as shown in FIG. 1.

Figure 3:
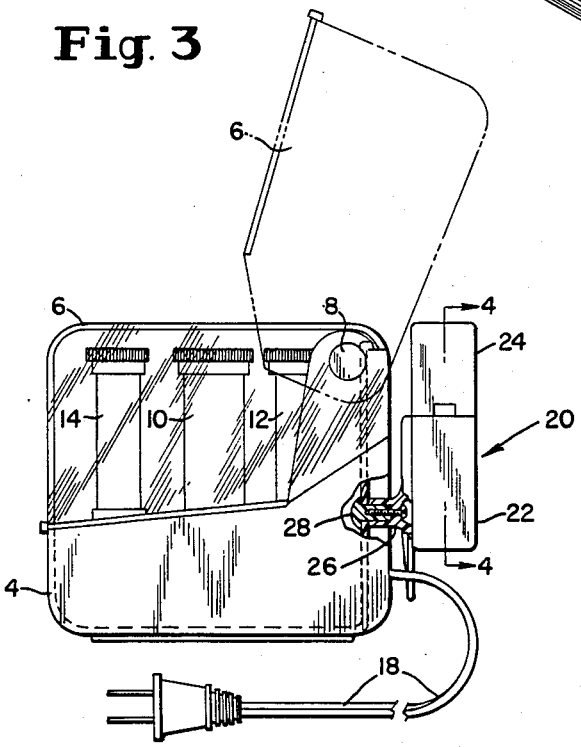
FIG. 3 is a side elevational view of the hair curling roller set shown in FIG. 1.
Figure 4:
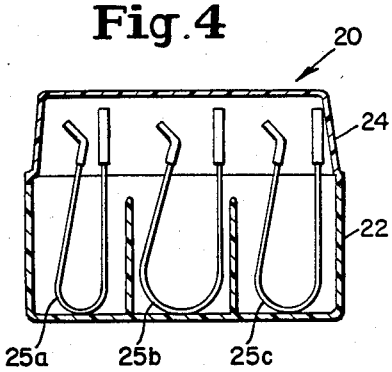
FIG. 4 is a front elevational cross-sectional view of the accessory compartment mounted on the back of the hair roller system shown in FIG. 3 with hair pins contained within the compartment.

Mounted on the back of housing 4 of hair curling set 2 is a detachable accessory compartment 20, as shown in FIG. 3. Accessory compartment 20 has a base 22 and a removable top 24. Base 22 is removably hooked onto a prong 26 which is connected by a connecting pin 28 to housing 4. Hair pins 25*a*, 25*b* and 25*c* can be held in accessory compartment 20 such as shown in FIG. 4. These hair pins of three different sizes are for use with the different size rollers.

Heat is supplied to the rollers by heat generated within the posts 16. The posts are heated by an electrical resistance network as conventional within the art. Electricity is supplied to the resistance network through the electric line cord 18.

Figure 8:
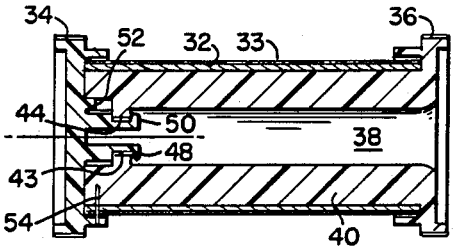
FIG. 8 is a sectional view of the flocked curling roller of FIG. 5.

A flocked curling roller 30, as shown in FIGS. 5, 7, 8, 9*a*, and 9*b* in accordance with the invention has an interior core member with a central hub 42 and a plurality of ribs 40, a hollow sleeve member 32, a first end ring 34 which is joined to one end of the interior core member and a second end ring 36 which is joined to the other end of the core member. End ring 36 preferably is integrally molded with the interior core member, as shown in FIG. 8. The core member has an opening 38 in one lateral end of the core member which opening extends longitudinally within the core member. A metal sleeve 39 is arranged in opening 38 and attached to the core member. Metal sleeve 39 has an opening 41 for placing the roller on a heating post for heating the roller. The core member is formed of a plastic material which is highly conductive of heat.

The hollow sleeve member 32 is located around the core member such that the inner surface of the hollow sleeve is in surface contact with the outer surface of the central core member. The outside surface of the hollow sleeve member is coated with a layer of flocking material 33 which has good heat conductive properties.

Figure 9A:
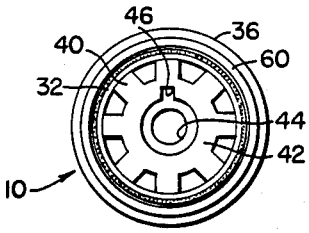
FIGS. 9*a* and 9*b* are cross-sectional views of two different size large rollers along lines A—A in FIG. 8 with the top end ring removed.
Figure 9B:
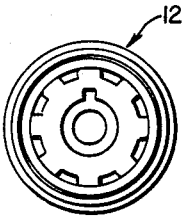
Figure 9C:
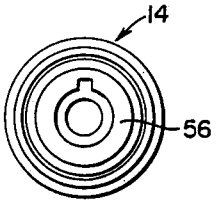
FIG. 9*c* is a cross-sectional view similar to FIGS. 9*a* and 9*b* but the view is of a small size roller.
Figure 7:
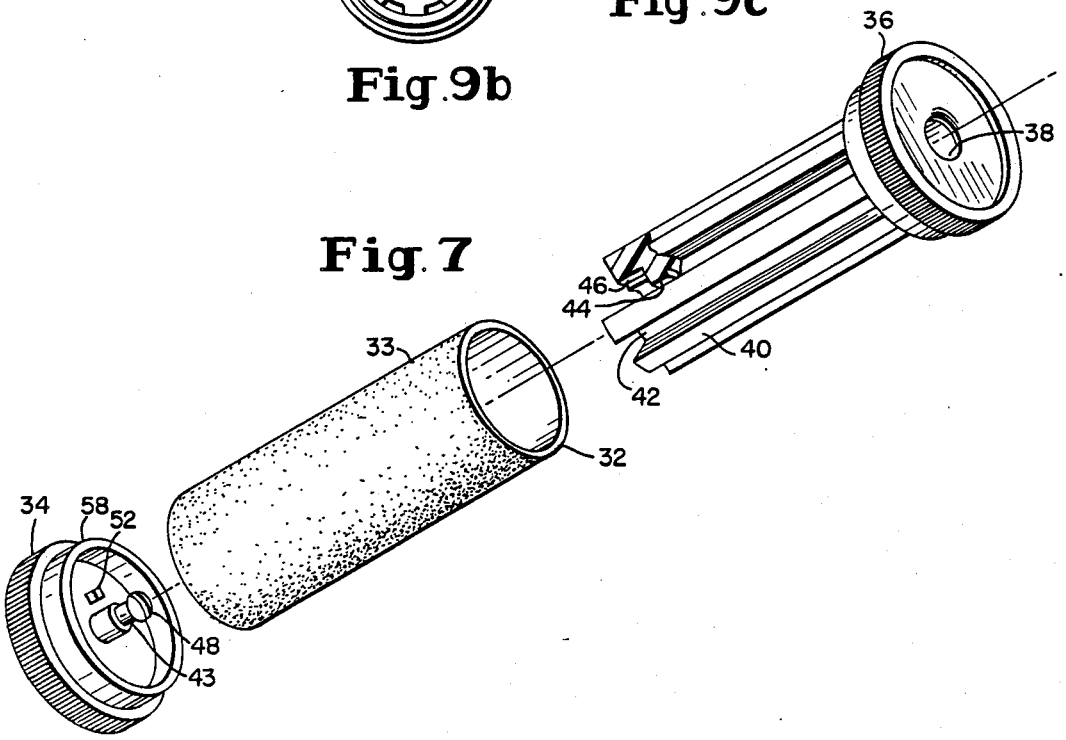
FIG. 7 is an exploded isometric view of a flocked curling roller constructed in accordance with the invention.

As shown in FIGS. 7, 9*a* and 9*b*, the two larger rollers, 10 and 12, have an interior core member which includes a central hub 42 surrounded by a plurality of ribs 40 which radially extend out from hub 42 and are spaced apart so as to be separated by air spaces. The ribs 40 serve as heat radiating fins in order to facilitate the transfer of heat from central hub 42, which is heated by posts 16 in curling set 2, to hollow sleeve member 32 and the layer of flocking material 33. If a solid core member was used in these larger rollers, the large solid core would prevent effective transfer of heat from the interior of the core member in contact with the heating posts 16 to the outer surface of the core member and the hollow sleeve member. The heat radiating ribs improves the heat transfer characteristics of the roller so that the layer of flocking material 33 on hollow sleeve 32 is heated to substantially the same level, i.e. temperature and concentration of heat, on the larger rollers as on the smaller rollers. As shown in FIGS. 9*a* and 9*b* the larger roller 10 includes longer ribs with greater air spaces between the ribs than the middle size roller 12. In contrast, however, the small rollers, such as roller 14 as shown in FIG. 9*c*, only has a central hub portion with no heat radiating ribs.

First end ring 34 an second end ring 36 have flanges 58 and 60, respectively. The inner diameter of each of flanges 58 and 60 is greater than the distance of the outside surface with layer 33 of flocking material on the hollow sleeve member 32 as can be seen from FIG. 8. The central hub 42 of the core member has an end 43 having an opening 44 having a diameter smaller than the opening 38 disposed in the other end of the central core member. The diameter of the cylindrical hole within the central hub 42, therefore, reduces from that of opening 38 to that of opening 44 in proximity to the end 43 to form a surface which engages attachment prongs 48 and 50 which are disposed in the center of the end ring 34.

The attachment prongs 48 and 50 on end ring 34 are made from a resilient material which has a memory for assuming its original shape such as plastic. The attachment prongs are used to fixedly engage end ring 34 within the end 43 of central hub 42. When attachment prongs 48 and 50 are inserted within opening 44, the prongs are pushed together so that they may clear the reduced diameter of the opening. After the outwardly tapered portions of the prongs have cleared opening 44, they spring back to their original position which causes their engagement with the reduced diameter section 43 of central hub 42 to lock the end ring 34 longitudinally in place within the end of the core member.

Rotation of the end ring 34 is prevented by a locking tab 52 which engages recess 46. The function of the locking means is to prevent rotation of the end ring with respect to the flocked surface around which the hair of the user is wrapped. In order to further secure end ring 34 to the core member, several pins, such as pin 54 can be used as shown in FIG. 8.

Figure 6:
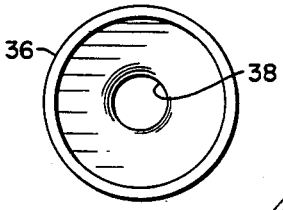
FIG. 6 is a bottom end view of the flocked curling roller of FIG. 5.

End rings 34 and 36 are manufactured from a material, such as plastic, which has a low coefficient of heat conduction. The low coefficient of heat conduction of end rings 34 and 36 prevents the user from being burned while wrapping hair around the flocked outside surface 33 which is designed to be heated to a high temperature by the insertion of a heating post 16 within the opening 41 of metal sleeve 39 inside of the interior core member and end ring 36, which are shown in FIG. 6.

The location of the inner surfaces of the flanges 58 and 60 of the end rings 34 and 36 so that it is not in surface contact with the flocked surface 33 on hollow sleeve member 32 but is spaced from such surface, provides several advantages. In the first place, the expansion and contraction of the diameter of the hollow sleeve member consequent from repeated heating and cooling cycles does not cause strain on the flanges and the end rings. Accordingly, with the arrangement of the present invention there is no possibility of expansion-contraction stress failure on the end caps which is possible with the flocked hair curling roller illustrated in U.S. Pat. No. 4,202,360. Second, since there is no surface contact between the flocked surface 33 and the inner surface of the flanges, the flocking is not worn or damaged by the attachment of end ring 34 to the core member.

Figure 10:
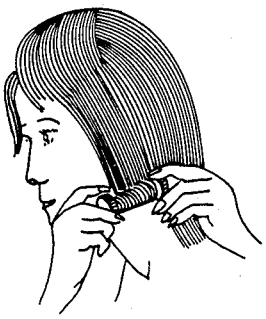
FIG. 10 is a view illustrating the use of the flocked curling roller of the present invention.

Preferably, the flocking material of layer 33 is nylon fiber having a diameter of approximately 3 denier and a length of approximately 0.5 mm. The flocking provides a large surface area which contacts the hair which is roller around the outside surface of the central core member by a user such as shown in FIG. 10. The large surface area of the flocking permits efficient heat transfer between the hollow sleeve member 32 and the hair which is wrapped around the outside flocked surface 33. In any conventional manner, the flocking is glued to the outside surface of the hollow sleeve member with any adhesive which is resistant to moisture and various commercial products which are used by women for setting and conditioning hair.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A hair curling roller system comprising:

a housing;

a plurality of post members arranged within said housing and being capable of generating heat in hair rollers placed on said post members, all of said post members of said system being of substantially the same diameter;

a plurality of rollers for curling hair, each of said rollers having an inner core means with an axially extending inner cavity and an outer surface for contact with hair to be rolled;

a first group of said plurality of rollers having a first outer diameter along their center section of their outer surface and a second group of said plurality of rollers having a second outer diameter along their center section of their outer surface with said second outer diameter being larger than said first outer diameter, each of said rollers of both of said groups of rollers having said axially extending inner cavity extending from an opening at one end of said roller and said inner cavities of all of said rollers having substantially the same inner diameter, each of said rollers being capable of being arranged on one of said post members such that said post member extends into said inner cavity of the respective said roller;

said core means of each of said rollers of said second group of rollers including heat transfer means for facilitating the transfer of heat from its said inner cavity to its said outer surface so that when both said groups of said rollers are positioned on said post members and are heated at approximately equal rates the level of heat on the outer surface of all of said rollers is approximately the same.

2. A system according to claim 1, wherein said heat transfer means in at least one of said rollers of said second group of rollers includes a plurality of heat radiating fins.

3. A system according to claim 1, wherein said heat transfer means in at least one of said rollers of said second group of rollers includes a cylindrical hub surrounding said inner cavity and a plurality of ribs arranged around said hub and extending in a radial direction out from said hub with air spaces remaining between adjacent ribs.

4. A system according to claim 3, wherein at least one of said rollers has an outer sleeve member and said outer sleeve member is coated with a flocking material so that the outer surface of said roller is a flocked outer surface.

5. A system according to claim 4, wherein at least one of said rollers has flanges mounted on its longitudinal ends, said flanges extend over but are spaced from said flocked outer sleeve.

6. A system according to claim 1, further comprising a prong member attached to one side of said housing and a carrying case for holding accessories for said rollers, said carrying case being capable of being hooked onto said prong member.

7. A system according to claim 6, wherein said prong member also serves to hold an electrical cord for said system which can be wrapped around said prong member.

8. A roller for curling hair comprising:

a hollow outer sleeve;

a central core member having an opening in one lateral end of said core member and extending longitudinally within said core member and said core member being formed of a material highly conductive of heat;

a plurality of ribs attached to and extending in a radial direction out from said core member, said ribs being formed of a material highly conductive of heat and being spaced around said core member and separate from each other by an air space for facilitating rapid transfer of heat from said central core member to said hollow outer sleeve member; and said hollow out sleeve member being arranged around and being adjacent to said ribs.

9. A roller according to claim 8, further comprising a first end ring attached to said core member at one lateral end thereof; and a second end ring having an attachment member, said second end ring being connected to said core member at the other lateral end thereof by said attachment member.

10. A roller according to claim 9, wherein both said first and second end rings are formed of a low heat conducting material.

11. A roller according to claim 9, wherein said opening in said core member extends through said core member from one lateral end surface to the other lateral end surface, said attachment member is a prong mounted on an inner surface of said second end ring facing said core member, and said prong is inserted into said opening in said core member for securing said second end ring to said core member.

12. A roller according to claim 11, wherein the portion of said opening at the end of said core member adjacent said second end ring is of a smaller diameter than the remainder of said opening extending through said core member.

13. A roller according to claim 12, wherein said prong has two parts formed of a resilient material with a space between said parts so that said parts can be squeezed together upon insertion of said prong into said opening in said core member and will snap back to their original position once said prong is inserted so as to secure said second end ring to said core member.

14. A roller according to claim 13, wherein both said first and second end rings are formed of a material having low heat conducting properties.

15. A roller according to claim 13, wherein said first end ring has an opening therein, such opening in said first end member is aligned with said opening in said core member and is approximately of the same diameter as said opening in said core member.

16. A roller according to claim 15, wherein said remainder of said opening in said core member is of a sufficient diameter and extends for a sufficient length from said first end ring to enable said roller to be arranged on a heat conductive rod for transmitting heat to said roller.

17. A roller for curling hair comprising:

a central core member having an axially extending inner cavity and a plurality of radially extending air gaps formed within said core members;

a longitudinally extending cylindrical member surrounding said core member;

a first end ring attached to said core member at one lateral end thereof; and a second end ring mounted at the opposite end of said cylindrical member.

18. A roller according to claim 17, wherein said first and second end rings are formed of a material having low heat conducting properties.

19. A hair curling roller system comprising:

a housing;

a plurality of post members arranged within said housing and being capable of generating heat in hair rollers placed on said post members;

a plurality of rollers for curling hair, each of said rollers having an inner core means with an axially extending inner cavity and an outer surface for contact with hair to be rolled;

a first group of said plurality of rollers having a first outer diameter along their center section of their outer surfaces and a second group of said plurality of rollers having a second outer diameter along their center section of their outer surfaces with said second outer diameter being larger than said first outer diameter, each of said rollers of both of said groups of rollers having said axially extending inner cavity extending from an opening at one end of said roller and said cavities of all of said rollers having substantially the same inner diameter, each of said rollers being capable of being arranged on one of said post members such that said post member extends into said inner cavity of the respective said roller:

said core means of each of said rollers of said second group of rollers including a cylindrical hub surrounding said inner cavity and a plurality of heat radiating ribs arranged around said hub and extending in a radial direction out from said hub with air spaces remaining between adjacent ribs, for facilitating the transfer of heat from its said inner cavity to its outer surface.

20. A system according to claim 19, wherein each of said rollers has an outer sleeve member and said outer sleeve member is coated with a flocking material so that the outer surface of each of said rollers is a flocked outer surface.

21. A system according to claim 20 wherein each of said rollers has flanges mounted on its longitudinal ends, said flanges extend over but are spaced from said flocked outer sleeve, and said flanges are formed of a low heat conducting material.

22. A system according to claim 19, further comprising a prong member attached to one side of said housing and a carrying case for holding accessories for said rollers, said carrying case being capable of being hooked onto said prong member.

23. A system according to claim 22, wherein said prong member also serves to hold an electrical cord for said system which can be wrapped around said prong member.

24. A hair curling roller system comprising:

a housing;

a plurality of post members, all having substantially the same outer diameters, arranged within said housing and adapted to be heated for heating hair rollers placed on said post members;

a plurality of rollers for curling hair, each of said rollers having an inner core means with an axially extending inner cavity and having an outer surface for contact with hair to be rolled;

a first group of said plurality of rollers having a first group outer diameter along their center section of their outer surfaces and a second group of said plurality of rollers having a second group outer diameter along their center section of their outer surfaces, said second group outer diameter being larger than said first group outer diameter, each of said rollers of both of said groups of rollers having said axially extending inner cavity extending from an opening at one end of said roller and said cavities of all of said rollers of both of said groups having substantially the same inner diameters, each of said rollers of both of said groups being capable of being arranged on any one of said post members such that said post member extends into said inner cavity of the respective said roller;

said core means of each of said rollers of said second group of rollers including a cylindrical hub surrounding said inner cavity and a plurality of heat radiating ribs arranged around said hub and extending in a radial direction out from said hub with air spaces remaining between adjacent ribs, for transferring heat from said inner cavity to said outer surface.

25. A hair curling roller system as in claim 24 wherein said post members and said inner cavities approximate right circular cylinders.

26. A hair curling roller system as in claim 25 wherein said inner core means of each of said rollers of said first group of rollers is essentially solid surrounding said axially extending inner cavity.

27. A hair curling roller system as in claim 26, wherein the dimensions of said heat radiating ribs have magnitudes such that the level of heat on the center section of said second group of rollers more closely proximates the level of heat on the center section of said first group of rollers than if said inner core means of said second group of rollers was an essentially solid core.

28. A hair curling roller system as in claim 26, wherein the dimensions of said heat radiating ribs have magnitudes such that at a temperature useful for curling hair, the level of heat on said center section of said second group of rollers more closely proximates the level of heat on said center section of said first group of rollers than if said inner core means of said second group of rollers was essentially solid core.

29. A hair curling roller system as in claim 26, wherein the dimensions of said heat radiating ribs have magnitudes such that the level of heat on said center section of said second group of rollers is approximately the same as the level of heat on said center section of said first group of rollers.

30. A hair curling roller system as in claim 24 wherein the said outer surface of said rollers is smoothly contoured.

* * * * *

UNITED STATES PATENT AND TRADEMARK OFFICE

CERTIFICATE OF CORRECTION

PATENT NO. : 4,881,559

DATED : November 21, 1989

INVENTOR(S) : Lai Kin

It is certified that error appears in the above-identified patent and that said Letters Patent is hereby corrected as shown below:

Column 1, line 5, line 51, change "non-hydroscopic" to --hygroscopic--; and line 58, after "cylinder" insert --.--.

Column 6, line 3, change "an" to --and--; and line 67, change "roller" to --rolled--.

Signed and Sealed this

Third Day of December, 1991

*Attest:*

*Attesting Officer*

HARRY F. MANBECK, JR.

*Commissioner of Patents and Trademarks*